US007611588B2

(12) United States Patent
Peitersen et al.

(10) Patent No.: US 7,611,588 B2
(45) Date of Patent: Nov. 3, 2009

(54) METHODS AND COMPOSITIONS FOR REMOVING METAL OXIDES

(75) Inventors: Nathan D. Peitersen, Richfield, MN (US); Robert D. Hei, Baldwin, WI (US); Richard K. Staub, Apple Valley, MN (US); Rick O. Ruhr, Buffalo, MN (US)

(73) Assignee: Ecolab Inc., St. Paul, MN (US)

( * ) Notice: Subject to any disclaimer, the term of this patent is extended or adjusted under 35 U.S.C. 154(b) by 747 days.

(21) Appl. No.: 11/000,261

(22) Filed: Nov. 30, 2004

(65) Prior Publication Data

US 2006/0112972 A1 Jun. 1, 2006

(51) Int. Cl.
*B08B 3/00* (2006.01)

(52) U.S. Cl. ..... 134/26; 134/2; 134/3; 134/22.1; 134/22.11; 134/22.12; 134/22.18; 134/22.19; 134/28; 134/30; 134/34; 134/35; 134/36; 134/40; 134/41; 134/42

(58) Field of Classification Search ..... 134/2, 134/3, 22.11, 22.12, 22.14, 22.18, 22.19, 134/26, 28, 30, 34, 35, 36, 40, 41, 42, 22.1
See application file for complete search history.

(56) References Cited

U.S. PATENT DOCUMENTS

| | | | | |
|---|---|---|---|---|
| 2,790,738 | A | 4/1957 | Alexander | |
| 2,861,015 | A | 11/1958 | Simon | |
| 2,981,609 | A | 4/1961 | Acker | |
| 3,007,780 | A | 11/1961 | Beigay | |
| 3,095,379 | A | 6/1963 | Schwartz | |
| 3,429,824 | A * | 2/1969 | Tate | 252/180 |
| 3,436,285 | A | 4/1969 | Wilkes | |
| 3,445,937 | A | 5/1969 | Groves | |
| 3,488,289 | A * | 1/1970 | Tate | 252/180 |
| 3,547,697 | A | 12/1970 | Frost | |
| 3,553,015 | A | 1/1971 | Dohogne | |
| 3,580,855 | A * | 5/1971 | Mickus | 252/181 |
| 3,660,078 | A | 5/1972 | Yamada | |
| 3,690,949 | A | 9/1972 | Ng | |
| 3,725,224 | A * | 4/1973 | Kendall | 205/722 |
| 3,741,747 | A | 6/1973 | Hamilton | |
| 3,749,618 | A | 7/1973 | Fannin | |
| 3,754,990 | A | 8/1973 | Teumac | |
| 3,761,312 | A | 9/1973 | Entwisle | |
| 3,832,234 | A * | 8/1974 | Otrhalek et al. | 134/4 |
| 3,887,403 | A | 6/1975 | Coggins | |
| 4,013,755 | A | 3/1977 | Weiler | |
| 4,038,364 | A | 7/1977 | Lailach | |
| 4,083,946 | A | 4/1978 | Schurr | |
| 4,098,688 | A * | 7/1978 | Nott | 209/166 |
| 4,113,588 | A | 9/1978 | Watanabe | |
| 4,116,755 | A | 9/1978 | Coggins | |
| 4,137,292 | A | 1/1979 | Tolley | |
| 4,174,290 | A | 11/1979 | Leveskis | |
| 4,250,048 | A | 2/1981 | Leveskis | |
| 4,264,418 | A | 4/1981 | Wood | |
| 4,292,090 | A | 9/1981 | Chao | |
| 4,314,876 | A | 2/1982 | Kremer | |
| 4,331,636 | A | 5/1982 | Svoronos | |
| 4,340,620 | A | 7/1982 | Mielsch | |
| 4,364,908 | A | 12/1982 | Rahm | |
| 4,381,249 | A | 4/1983 | Bouffard | |
| 4,414,039 | A | 11/1983 | Thoma | |
| 4,430,128 | A | 2/1984 | Freinier | |
| 4,441,930 | A | 4/1984 | Baudis | |
| 4,470,920 | A | 9/1984 | Leveskis | |
| 4,496,404 | A | 1/1985 | King | |
| 4,517,163 | A | 5/1985 | Jödden | |
| 4,525,250 | A | 6/1985 | Fahrmbacher-Lutz | |
| 4,529,450 | A | 7/1985 | Panayappan | |
| 4,591,391 | A | 5/1986 | Shimizu | |
| 4,599,114 | A | 7/1986 | Atkinson | |
| 4,623,399 | A | 11/1986 | Frenier | |
| 4,636,327 | A | 1/1987 | Frenier | |
| 4,731,126 | A | 3/1988 | Dixit | |

(Continued)

FOREIGN PATENT DOCUMENTS

| | | |
|---|---|---|
| CN | 1074717 | 7/1993 |
| DE | 2757592 | 7/1979 |
| DE | 3030964 | 3/1982 |
| DE | 3123425 | 12/1982 |
| DE | 3226670 | 2/1983 |
| DE | 3203482 | 8/1983 |
| DE | 3217145 | 11/1983 |
| DE | 3223068 | 12/1983 |
| DE | 3301703 | 7/1984 |
| DE | 3320641 | 12/1984 |

(Continued)

OTHER PUBLICATIONS

"Zeta Potential In Colloid Science", p. 228-229, 2 pages.
Busnaina, Moumen, & Piboontum, "Effective Contact Post-CMP Cleaning", Clarkson University, NY, Semiconductor Fabtech—9th Edition, ISSN: 0087-6326, pp. 289-282.
Mikhaylichenko, Ravkin, and Lam Research Corp, CA, Stein & Hetherington, Sandia National Laboratory, NM, "Comparing Contact and Non-Contact Technology for Post-CMP Cleaning", Semiconductor Fabtech—11th Edition, pp. 301-307.

(Continued)

*Primary Examiner*—Sharidan Carrillo
(74) *Attorney, Agent, or Firm*—Andrew D. Sorensen

(57) ABSTRACT

The invention relates to methods and compositions for removing metal oxide soils from surfaces. The compositions include an anionic surfactant and a pH adjuster at an acidic pH. In one embodiment, the invention relates to a method of removing a metal oxide soil from a surface by (1) applying a use composition to the surface, the use composition having a pH adjuster in an amount sufficient to provide a use pH at or below 7, an anionic surfactant in an amount to remove a portion of the metal oxide soil, and a carrier, (2) removing the metal oxide soil from the surface with the use composition, and (3) rinsing the surface to remove the use composition and the metal oxide soil.

17 Claims, No Drawings

U.S. PATENT DOCUMENTS

| | | | | |
|---|---|---|---|---|
| 4,800,132 | A | 1/1989 | Grunwald | |
| 4,806,259 | A * | 2/1989 | Amjad | 510/162 |
| 4,810,405 | A | 3/1989 | Waller | |
| 4,832,868 | A | 5/1989 | Schmid | |
| 4,867,853 | A | 9/1989 | Hauffe | |
| 4,877,482 | A | 10/1989 | Knapp | |
| 4,921,629 | A | 5/1990 | Malihi | |
| 4,931,102 | A | 6/1990 | Burke | |
| 5,011,661 | A | 4/1991 | Schäfer | |
| 5,074,972 | A | 12/1991 | Matz | |
| 5,137,793 | A | 8/1992 | Cockrell | |
| 5,171,459 | A * | 12/1992 | Kaplan | 507/236 |
| 5,215,676 | A | 6/1993 | Stone | |
| 5,232,619 | A | 8/1993 | Sue | |
| 5,266,108 | A | 11/1993 | Hauck | |
| 5,282,977 | A | 2/1994 | Schinkitz | |
| 5,290,362 | A | 3/1994 | Sue | |
| 5,332,433 | A | 7/1994 | Story | |
| 5,338,367 | A | 8/1994 | Henriet | |
| 5,411,719 | A | 5/1995 | Hollitt | |
| 5,451,335 | A | 9/1995 | Hieatt | |
| 5,482,174 | A | 1/1996 | Namiki | |
| 5,575,863 | A | 11/1996 | Sala | |
| 5,607,911 | A * | 3/1997 | Levin et al. | 510/253 |
| 5,609,692 | A * | 3/1997 | Johnson et al. | 134/3 |
| 5,662,769 | A | 9/1997 | Schonauer | |
| 5,685,917 | A | 11/1997 | Sangeeta | |
| 5,763,377 | A | 6/1998 | Dobrez | |
| 5,797,986 | A | 8/1998 | Rolando | |
| 5,808,118 | A | 9/1998 | Atkinson | |
| 5,858,463 | A | 1/1999 | Ogura | |
| 5,885,364 | A * | 3/1999 | Hieatt et al. | 134/22.11 |
| 5,993,558 | A | 11/1999 | Webster | |
| 6,017,505 | A | 1/2000 | Ziegler | |
| 6,060,122 | A | 5/2000 | Rossmaier | |
| 6,156,129 | A * | 12/2000 | Hlivka et al. | 134/42 |
| 6,210,558 | B1 | 4/2001 | Demertzis | |
| 6,217,668 | B1 | 4/2001 | Czech | |
| 6,241,826 | B1 | 6/2001 | Dittmer | |
| 6,274,027 | B1 | 8/2001 | Kiya | |
| 6,348,092 | B1 | 2/2002 | Atkinson | |
| 6,348,440 | B1 * | 2/2002 | Meskers et al. | 510/253 |
| 6,399,540 | B1 | 6/2002 | Oki | |
| 6,419,755 | B1 | 7/2002 | Arruda | |
| 6,627,546 | B2 | 9/2003 | Kneer | |
| 6,640,816 | B2 | 11/2003 | Gonzales | |
| 6,706,122 | B2 | 3/2004 | Wijngaard | |
| 6,926,836 | B2 * | 8/2005 | Fidoe et al. | 210/700 |
| 2003/0150613 | A1 * | 8/2003 | Freiter | 166/279 |
| 2004/0221870 | A1 * | 11/2004 | Canoiranzo et al. | 134/3 |
| 2005/0003091 | A1 | 1/2005 | Schoennenbeck | |

FOREIGN PATENT DOCUMENTS

| | | |
|---|---|---|
| DE | 3412329 | 10/1985 |
| DE | 3531683 | 3/1987 |
| DE | 3740610 | 8/1988 |
| DE | 3910042 | 10/1990 |
| DE | 4101843 | 4/1992 |
| DE | 4110595 | 11/1992 |
| DE | 4123772 | 1/1993 |
| DE | 4339502 | 6/1995 |
| DE | 4419276 | 12/1995 |
| DE | 4218916 | 3/1996 |
| DE | 19506857 | 8/1996 |
| DE | 19521596 | 11/1996 |
| DE | 19530551 | 3/1997 |
| DE | 19636370 | 3/1998 |
| DE | 1983738 | 3/2000 |
| DE | 10005124 | 8/2001 |
| DE | 10026864 | 12/2001 |
| DE | 10049777 | 4/2002 |
| EP | 0040461 | 1/1984 |
| EP | 0104012 | 3/1984 |
| EP | 0072986 | 12/1984 |
| EP | 0086245 | 5/1987 |
| EP | 0299166 | 1/1989 |
| EP | 0414820 | 3/1993 |
| EP | 0276501 | 4/1994 |
| EP | 0592892 | 4/1994 |
| EP | 0475953 | 8/1994 |
| EP | 0415807 | 10/1994 |
| EP | 0388749 | 6/1995 |
| EP | 0506928 | 9/1995 |
| EP | 0547088 | 4/1998 |
| EP | 0717723 | 4/1998 |
| EP | 0849377 | 6/1998 |
| EP | 0759097 | 8/1998 |
| EP | 0636712 | 10/1998 |
| EP | 0654508 | 5/1999 |
| EP | 0817871 | 6/1999 |
| EP | 0909344 | 8/2000 |
| EP | 0769570 | 9/2000 |
| EP | 1142630 | 10/2001 |
| EP | 0960221 | 3/2002 |
| EP | 0964940 | 4/2002 |
| EP | 0922124 | 5/2002 |
| EP | 1211563 | 6/2002 |
| EP | 1306468 | 5/2003 |
| JP | 62260081 | 11/1987 |
| JP | 62260082 | 11/1987 |
| JP | 62260083 | 11/1987 |
| JP | 3150375 | 6/1991 |
| JP | 3290475 | 12/1991 |
| JP | 4041687 | 2/1992 |
| JP | 4052290 | 2/1992 |
| JP | 5112885 | 5/1993 |
| JP | 6228778 | 8/1994 |
| JP | 7041971 | 2/1995 |
| JP | 7157697 | 6/1995 |
| JP | 7166113 | 6/1995 |
| KR | 9205094 | 6/1992 |
| WO | WO92/07110 | 4/1992 |
| WO | WO96/19553 | 6/1996 |
| WO | WO97/31136 | 8/1997 |
| WO | WO9844167 | 10/1998 |
| WO | WO99/64646 | 12/1999 |
| WO | WO00/46423 | 8/2000 |
| WO | WO01/09275 | 2/2001 |
| WO | WO01/30888 | 5/2001 |
| WO | WO02/49960 | 6/2002 |
| WO | WO02/051945 | 7/2002 |
| WO | WO02/061158 | 8/2002 |
| ZA | 9006002 * | 5/1991 |

OTHER PUBLICATIONS

Small, Peterson, Gorman, and Chan, "Post Clean Treatments and Post CMP Solutions for Metal and Particle Removal from VLSI Structures", EKC Technology, Inc., CA, Semicondutor Fabtech—8th Edition, pp. 231- 237.

FDA, "Indirect food additives; adhesives and components of coatings", Fed. Regist., 1999, 2567-2568.

Rowe, "Knowledge representation in the prediction of the opacity of tablet film coatings containing titanium dioxide", Zeneca Pharmaceuticals, U.K., 1995, pp. 215-218.

FDA, "Indirect food additives; adhesives and components of coatings", Fed. Regist., 1995, ISSN: 0097-6326, 57338-9.

Lehtola, Heinamaki, Nikupaavo, and Yliruusi "The effect of titanium dioxide on mechanical, permeability and adhesion properties of aqueous-based hydroxypropyl methyl cellulose films", Boll. Chim. Farm., ISSN: 0006-6648, 1994, 709-14.

Lehtola, Heinamaki, Nikupaavo, and Yliruusi "The mechanical and adhesion properties of aqueous-based hydroxypropyl methyl cellulose coating systems containing polydextrose and titanium dioxide", Drug Dev. Ind. PHarm., ISSN: 0363-9045, 1995, 675-85.
Bechard, Quaraishi, and Kwong, "Film coating: effect of titanium dioxide concentration and film thickness on the photostability of nifedipine", Int. J. Pharm. ISSN: 0378-5173, 1992, p. 133-9.
Rowe, and Roberts, "The effect of some formulation variable son crack propagation in pigmented tablet film coatings using computer simulation", Int. J. Pharm., ISSN: 0378-5173, 1992, pp. 49-58.
Bohan, "Experimental investigation of adhesive forces operative in transient agglomeration of cohesive powders", Proc. Conf. Semin. Reed Exhibition Companies, 1996, pp. 309-314.
Hassan, Kaloustian, Prinderre, Ramsis, Khaled, Faham, Tous, Maury, and Joachim, "Physicochemical study on the interactions between amoxicillin trihydrate and some excipients used in solid dosage forms", Laboratoire Pharmacie Galenique Industrielle, Fr., ISSN: 0031-7144, 1996, pp. 400-403.
Maul and Schmidt, "Influence of different-shaped pigments on bisacodyl release from Eudragit L 30 D", University of Tuebingen, Germany, ISSN: 0378-5173, 1995, pp. 103-112.
Samura, Kato, Morita, Kawamura, Koyama, and Osawa, "Effect of water-soluble powder addition on physical properties of gelatin gel", Dep. OTC Drug Paramed. Formul. Eisai Co., Ltd., Japan, ISSN: 0363-9045, 1993, pp. 2579-2594.
Delau, Maes, and Roelandts, "The relative importance of the components used for ultraviolet A protection in broadspectrum sunscreens", Photodermatol. Photoimmunol. Photomed., ISSN: 0905-4383, 1992.
Rowe, "Interactions in powders and granules. A reappraisal", ICI Pharm., U.K., 1992, ISSN: 0378-5173, pp. 257-261.
Ortyl, and Peck, "Surface charge of titanium dioxide and its effect on dye adsorption and aqueous suspension stability", Drug Dev., Ind. Pharm., ISSN: 0363-9045, 1991, pp. 2245-2268.
Mueller, Lucks, Stampa, and Mueller, "Effect of antiflocculants on suspension stability and size distribution. An investigation by laser light scattering techniques", Dep. Pharm., ISSN: 0031-711X, 1990, pp. 789-793.
Hamano, Mitsuhashi, Aoki, Yamaoto, Tsuji, Ito, and Oji, "Colorimetric micro-determination of titanium dioxide in foods", Public Health Res. Inst. Japan, ISSN: 0029-0394, 1990, pp. 162-166.
Ishikawa, Kobayashi, and Samejima, "Powder-filled semisolids: influence of powder addition to Vaseline on the rheological properties", Prod. Formul. Res. Lab., Japan, ISSN: 0009-2363, 1989, pp. 1355-1361.
Murthy, Enders, and Fawzi, "Dissolution stability of hard-shell capsule products, part I: the effect of exaggerated storage conditions", Parke-Davies Pharm. Res. Div., NJ, ISSN: 0147-8087, 1989, pp. 72, 75-76, 78-79, 82, 84, 86.
Zhao, Wu, Wu, Hidaka, and Serpone, "Photodegradation of dyes with poor solubility in an aqueous surfactant/TiO2 dispersion under visible light irradiation", J. Chem. Soc., ISSN: 0956-5000, 1998, pp. 673- 676.
Ziemniak, Jones, and Combs, "Solubility behavior of titanium (IV) oxide in alkaline media at elevated temperatures", Knolls At. Power Labs., NY, 1992, Abstract No. 16095.
Kuznetsov and Barsukova, "Solubility of titanium dioxide in high-temperature fluoride solutions and crystallization of titanates by a hydrothermal method", Tezisy Dokl. Vses. Soveshch. Rostu Krist., 5th (1997), vol. 2, 91.
Inyushkina, Vil'nyanskii, Kareva, and Sultanova, "Solubility of titanium dioxide in a melt of alkali metal chlorides", Ural. Politekh. Inst. Im. Kirova, Sverdlovsk, USSR, 1974, pp. 1459-1461.
Maskara, and Smith, Agglomeration during the drying of fine silica powders, part II: The role of particle solubility, University of New Mexico, ISSN: 0002-7820, 1997, pp. 1715-1722.
Grimes, "Solution of MgO, CaO, and TiO2 in alpha. -Al203", J. Am. Ceram. Soc., ISSN: 0002-7820, 1994, pp. 378-384.
Ziemniak, Jones, and Combs, "Solubility behavior of titanium (IV) oxide in alkaline media at elevated temperatures", Knolls At. Power Lab., NY, ISSN: 0095-9782, 1993, pp. 601-623.
Rowe, "Interactions in colored powders and tablet formulations: a theoretical approach based on solubility parameters", ICI Pharm., UK. ISSN: 0378-5173, 1989, pp. 47-51.
Kwoka, "Titanium dioxide", Dupont White Pigment Mineral Products, USA, 1997, pp. 157-186.
Bergado, "Working with titanium dioxide today: Part I—Pigment properties", Kronos, Inc. NJ, ISSN: 0148-9119, 1994, pp. 32, 34, 36, 38.
Judin, "The lighter side of titanium dioxide", Kemira TiO2, Finland, ISSN: 0009-3106, 1993, pp. 503-505.
Finklea, "Titanium dioxide and strontium titanate (SrTiO3", Dep. Chem., WV, ISSN:0167-6881, 1988, pp. 43-145.
Parfitt, "The surface of titanium dioxide", Tioxide nst. Ltd., Engl., 1976, pp. 11, 181-226.
Rackham, "Ease of dispersion of titanium dioxide", Br. Titan Prod., Engl., 1972, pp. 7-11.

* cited by examiner

METHODS AND COMPOSITIONS FOR REMOVING METAL OXIDES

FIELD OF THE INVENTION

The invention relates to methods and compositions for removing metal oxide soils from surfaces. The compositions include an anionic surfactant and a pH adjuster at an acidic pH.

BACKGROUND

Metal oxides are used for a variety of reasons, including as pigments, in many industries including the food and beverage industry, dairy industry, pharmaceutical industry, and cosmetic industry. In other industries, such as the semiconductor industry, metal oxides are a by-product of manufacturing. These metal oxides are known to cause soiling.

The dairy industry is increasingly using metal oxides, and titanium dioxide in particular, in dairy products, and low fat dairy products. Adding titanium dioxide to low fat dairy products such as milk, yogurt, cheese, sour cream, cottage cheese, cream cheese and butter whitens the product to provide the appearance of a higher fat content. Titanium dioxide has been added to dairy products since the 1970's.

Generally, titanium dioxide has been added to dairy products prior to pasteurization. The pasteurization step involves heating the dairy product. As a result of heating, titanium dioxide has an increased tendency to soil the surface it contacts. In addition to building up on and around the heat exchanger, the titanium dioxide is known to deposit on other pieces of processing equipment where there may be low flow or indirect spraying of the milk product.

In recent years, the United States Department of Agriculture has focused attention on titanium dioxide soiling in dairy facilities. Efforts have been directed to addressing titanium dioxide soiling. See U.S. Pat. No. 5,763,377 to Dobrez et al.

Prior cleaning products have been used in the cleaning of dairy facilities having titanium dioxide soiling. The EVAP-O-KLEEN® cleaning product from Ecolab Inc. has been used since the early 1980's in these facilities. The EVAP-O-KLEEN® cleaning product is an aqueous composition containing a mixture of nitric acid and phosphoric acid, and an organic surfactant. The EVAP-O-KLEEN® cleaning product has been used to provide CIP (clean-in-place) cleaning in dairy facilities for removal of mineral buildup such as titanium dioxide soiling, and for leaving the equipment surfaces bright and shiny. Typically, surfaces with titanium dioxide soiling have a white, cloudy appearance. CIP cleaning generally refers to the cleaning of processing equipment in a circuit without the disassembly of large processing equipment which is often too expensive.

The pharmaceutical industry uses metal oxides such as titanium dioxide as a pigment, for example, in the coatings of pills. This titanium dioxide builds up on the processing equipment, creating a white, cloudy soil. The pharmaceutical industry has a "zero tolerance" for any soil on the equipment. This means that during cleaning any visible soil, such as titanium dioxide must be cleaned off the equipment. In the pharmaceutical industry, some equipment is cleaned using a clean-in-place system, however, many pieces of equipment are cleaned manually, which is time consuming and costly.

SUMMARY OF THE INVENTION

Surprisingly, it has been discovered that metal oxide soils can be removed from surfaces using a composition including an anionic surfactant and a pH adjuster at an acidic pH.

In one embodiment, the invention relates to a method of removing a metal oxide soil from a surface by (1) applying a use composition to the surface, the use composition having a pH adjuster in an amount sufficient to provide a use pH at or below 7, an anionic surfactant in an amount to remove a portion of the metal oxide soil, and a carrier, (2) removing the metal oxide soil from the surface with the use composition, and (3) rinsing the surface to remove the use composition and the metal oxide soil.

These and other embodiments will be apparent to those of skill in the art and others in view of the following detailed description of some embodiments. It should be understood, however, that this summary, and the detailed description illustrate only some examples of various embodiments, and are not intended to be limiting to the invention as claimed.

DETAILED DESCRIPTION

As previously discussed, metal oxide soils have a tendency to accumulate on equipment surfaces and the environment located near equipment and are difficult to remove when using conventional cleaning programs. Examples of commonly used metal oxides include titanium dioxide, iron oxide, zinc oxide, chromium oxide, silica dioxide, aluminum oxide, and magnesium oxide. These metal oxides become part of the soil the builds up on equipment surfaces and the environment during normal use, forming a soil containing a metal oxide. These soils include any byproduct of the process which is left behind from the final product. The "metal oxide soil" is that which remains on the surface of equipment and the environment after conventional cleaning and/or sanitizing steps. The metal oxide soil includes modified metal oxides, metal oxide residues, or other metal oxides, and organic soils from food, beverage or dairy products, silicone, oils, emulsifying agents and the like from cosmetics, and lacquers, polyalcohols, and acrylic polymers such as Eudragit® from pharmaceuticals.

Metal oxides may accumulate on a variety of surfaces. For example, the surface may be any surface normally encountered in processing equipment including but not limited to stainless steel, mild steel, aluminum, rubber, glass, and polymers, an example of which is polytetrafluoroethylene sold under the name Teflon®. The surface may be part of a piece of equipment or the environment including but not limited to silos, vats, pipelines, heat exchangers, pasteurizers, trucks, fillers, separators, contherms, blenders, extruders, conveyors, mix tanks, homogenizers, evaporators, membranes, floors, walls, and the like.

Metal oxides are used in a variety of industries. For example, metal oxides are used as pigments in the food, beverage, dairy, cosmetic and pharmaceutical industries. Also, metal oxides are produced as a by-product in the semiconductor industry.

Surprisingly, it has been discovered that metal oxide soils may be removed from a surface by using a composition having a pH adjuster or buffer system and an anionic surfactant at an acidic pH.

DEFINITIONS

For purposes of this invention, all numeric values are herein assumed to be modified by the term "about," whether or not explicitly indicated. The term "about" generally refers to a range of numbers that one of skill in the art would consider equivalent to the recited value (i.e., having the same function or result). In many instances, the term "about" may include numbers that are rounded to the nearest significant figure.

Weight percent, percent by weight, % by weight, and the like are synonyms that refer to the concentration of a substance as the weight of that substance divided by the weight of the composition and multiplied by 100.

The recitation of numerical ranges by endpoints includes all numbers subsumed within that range (e.g. 1 to 5 includes 1, 1.5, 2, 2.75, 3, 3.80, 4 and 5).

As used in this specification and the appended claims, the singular forms "a", "an", and "the" include plural referents unless the content clearly dictates otherwise. Thus, for example, reference to a composition containing "a compound" includes a mixture of two or more compounds. As used in this specification and the appended claims, the term "or" is generally employed in its sense including "and/or" unless the content clearly dictates otherwise.

Compositions

The compositions of the invention hereinafter referred to as "the compositions" are those compositions for removing metal oxides from a surface and include an anionic surfactant and a pH adjuster or buffer system. The compositions may optionally include other ingredients that increase the effectiveness of the composition or provide an additional function or benefit. For example, the compositions may optionally include a carrier, a surfactant, a foamer, a defoamer/antifoaming agent, buffer, hydrotrope/coupler, enzyme, chelating agent, sequestering agent, threshold inhibiting agent, antimicrobial agent or preservative, fragrance, dye, viscosity modifer, oxidizer, and mixtures thereof.

The compositions may be a concentrate or a use composition. The concentrate refers to the composition that is diluted to form the use composition. The concentrate may be a solid, liquid, paste, gel, powder, tablet, or the like. The concentrate is preferably a liquid. The use composition refers to the composition that is applied to a surface to remove the metal oxide. For example, the concentrate may be diluted with water to a 1% use composition (0.4% to 0.7% active) and then applied to the surface. It may be beneficial to form the composition as a concentrate and dilute it to a use composition on-site. The concentrate is often easier and less expensive to ship than the use composition.

Anionic Surfactant

The composition includes an anionic surfactant. Some non-limiting examples of anionic surfactants that may be used include surfactants where carboxylate, sulfonate, sulfate and phosphate groups are the polar (hydrophilic) solubilizing groups. The anionic surfactant may include a cationic counter ion, including but not limited to sodium, lithium, potassium, ammonium and substituted ammonium, calcium, barium, and magnesium. Of the cations (counter ions) associated with these polar groups, sodium, lithium and potassium impart water solubility; ammonium and substituted ammonium ions provide both water and oil solubility; and, calcium, barium, and magnesium promote oil solubility.

The majority of large volume commercial anionic surfactants for use in the present composition can be subdivided into five major chemical classes and additional sub-groups known to those of skill in the art and described in "Surfactant Encyclopedia", *Cosmetics & Toiletries*, Vol. 104 (2) 71-86 (1989). The first class includes acylamino acids (and salts), such as acylgluamates, acyl peptides, sarcosinates (e.g. N-acyl sarcosinates), taurates (e.g. N-acyl taurates and fatty acid amides of methyl tauride), and the like. The second class includes carboxylic acids (and salts), such as alkanoic acids (and alkanoates), ester carboxylic acids (e.g. alkyl succinates), ether carboxylic acids, and the like. The third class includes phosphoric acid esters and their salts. The fourth class includes sulfonic acids (and salts), such as isethionates (e.g. acyl isethionates), alkylaryl sulfonates, alkyl sulfonates, sulfosuccinates (e.g. monoesters and diesters of sulfosuccinate), and the like. The fifth class includes sulfuric acid esters (and salts), such as alkyl ether sulfates, alkyl sulfates, and the like.

Anionic sulfate surfactants suitable for use in the present compositions include the linear and branched primary and secondary alkyl sulfates, alkyl ethoxysulfates, fatty oleyl glycerol sulfates, alkyl phenol ethylene oxide ether sulfates, the $C_5$-$C_{17}$ acyl-N—($C_1$-$C_4$ alkyl) and —N—($C_1$-$C_2$ hydroxyalkyl)glucamine sulfates, and sulfates of alkylpolysaccharides such as the sulfates of alkylpolyglucoside (the nonionic nonsulfated compounds being described herein).

Examples of suitable synthetic, water soluble anionic detergent compounds suitable for use in the present compositions include the amine and substituted amine (such as mono-, di- and triethanolamine) and alkali metal (such as sodium, lithium and potassium) salts of the alkyl mononuclear aromatic sulfonates such as the alkyl benzene sulfonates containing from about 5 to about 18 carbon atoms in the alkyl group in a straight or branched chain, e.g., the salts of alkyl benzene sulfonates or of alkyl toluene, xylene, cumene and phenol sulfonates; alkyl naphthalene sulfonate, diamyl naphthalene sulfonate, and dinonyl naphthalene sulfonate and alkoxylated derivatives.

Anionic carboxylate surfactants suitable for use in the present compositions include the alkyl ethoxy carboxylates, the alkyl polyethoxy polycarboxylate surfactants and the soaps (e.g. alkyl carboxyls). Secondary soap surfactants (e.g. alkyl carboxyl surfactants) useful in the present compositions include those which contain a carboxyl unit connected to a secondary carbon. The secondary carbon can be in a ring structure, e.g. as in p-octyl benzoic acid, or as in alkyl-substituted cyclohexyl carboxylates. The secondary soap surfactants typically contain no ether linkages, no ester linkages and no hydroxyl groups. Further, they typically lack nitrogen atoms in the head-group (amphiphilic portion). Suitable secondary soap surfactants typically contain 11-13 total carbon atoms, although more carbons atoms (e.g., up to 16) can be present.

Other anionic detergents suitable for use in the present compositions include olefin sulfonates, such as long chain alkene sulfonates, long chain hydroxyalkane sulfonates or mixtures of alkenesulfonates and hydroxyalkane-sulfonates. Also included are the alkyl sulfates, alkyl poly(ethyleneoxy) ether sulfates and aromatic poly(ethyleneoxy) sulfates such as the sulfates or condensation products of ethylene oxide and nonyl phenol (usually having 1 to 6 oxyethylene groups per molecule). Resin acids and hydrogenated resin acids are also suitable, such as rosin, hydrogenated rosin, and resin acids and hydrogenated resin acids present in or derived from tallow oil.

Further examples of suitable anionic surfactants are given in "Surface Active Agents and Detergents" (Vol. I and II by Schwartz, Perry and Berch). A variety of such surfactants are also generally disclosed in U.S. Pat. No. 3,929,678, issued Dec. 30, 1975 to Laughlin, et al. at column 23, line 58 through column 29, line 23.

Preferred anionic surfactants are those that exhibit a negative charge at the use pH. Further, it has been discovered that an anionic surfactant or surfactant mixture that is at or near its solubility limit in the use composition achieves the most removal of the metal oxide soil. The turbidity of the use composition may be measured as an indicator of the surfactant being at or approaching its solubility limit. Turbidity is measured in nephelometric turbidity limits (NTU's), with more turbid compositions having a higher NTU. Preferred use compositions for the present invention will have a turbidity up to 1000 NTU, and 10-100 NTU, however, it is understood that there are compositions that fall outside of these ranges.

Particularly preferred anionic surfactants in the present invention are phosphate esters. Phosphate esters include the mono-ester, di-ester, and tri-ester phosphoric acid esters and their salts. Useful structures are shown below, where R groups can be an alkyl, alkyl ether, alkyl phenol ester, etc:

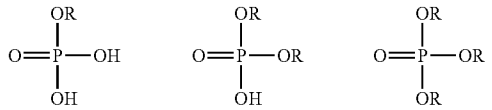

mono-ester Di-ester Tri-ester

The above structures can also be neutralized by a variety of sources, such as sodium hydroxide, potassium hydroxide, amines, etc. Commercially available phosphate ester surfactants typically are comprised of blends between mono, di, and/or tri-esters as well as the hydrophobes (such as nonionic surfactants) which are not phosphated during the manufacturing process. It has been found that the diphosphate esters are better dispersants than the mono-phosphate esters. This is believed to be attributed to the diphosphate ester being more bulky than the mono-phosphate ester.

The ratio of the components as well as the nature of the hydrophobe will determine the properties of the commercial surfactant. For example, the type of hydrophobic chain, the number of carbon molecules in the hydrophobic chain, the presence and type of phenol derivative, the level of ethoxylation, and whether the phosphate ester is a mono- or di-ester may be selected depending on the desired characteristics. $C_8$ and related fatty alcohols produce very low foam, $C_{12}$ and related fatty alcohols are an emulsifier, and $C_{16-18}$ fatty alcohols are defoamers and emulsifiers. $C_{8-10}$ fatty alcohol ethoxylates exhibit excellent wetting, good detergency.

The most preferred phosphate esters for the present invention are alkyl ethoxylate phosphate esters. In particular aliphatic $C_{11-15}$ alkyl chain lengths with 3-9 moles of ethoxylation show very good performance. Additionally, $C_{7-11}$ alkyl phenols with 3-9 moles of ethoxylation show very good performance. An example of a preferred alkyl ethoxylate phosphate ester is a nonyl phenol 6 mole ethoxylate phosphate ester. A preferred aliphatic ethoxylated phosphate ester is a tridecyl alcohol 5 mole ethoxylate phosphate ester, sold under the name Crodafos T-5A, commercially available from Croda.

As previously discussed, the composition may be sold as a concentrate or as a use composition. The concentrate refers to a composition that is diluted to form a use composition. The use composition refers to the composition that is applied to a surface to remove the metal oxide soil. The anionic surfactant blend can comprise up to about 99 wt. % of the final concentrate composition. For example, the anionic surfactant can comprise from about 0.001 to about 99 wt. % of the final concentrate composition, from about 1 to about 90 wt. % of the final concentrate composition, and from about 10 to about 60 wt. % of the final concentrate composition.

The anionic surfactant can comprise up to 50 wt. % of the use composition. For example, the anionic surfactant can comprise from about 0.0001 to about 50 wt. % of the use composition, from about 0.001 to about 5 wt. % of the use composition, and from about 0.01 to about 0.1 wt. % of the use composition.

pH Adjuster

The composition preferably includes a pH adjuster also known as a buffer system. The pH of the system is from about 0.1 to about 8, 1 to about 6, and 1.5 to about 5.8. Suitable pH adjusters will maintain the composition within the desired pH range.

The pH adjuster can include an acid and a base. The acid preferably has a pKa between about 1 and about 4, and most preferably between about 2.5 and about 2.9. Examples of suitable acids include phosphoric acid and the organic acids such as hydroxyacetic (glycolic) acid, formic acid, acetic acid, propionic acid, butyric acid, valeric acid, caproic acid, gluconic acid, itaconic acid, trichloroacetic acid, benzoic acid and the like; and organic dicarboxylic acids such as oxalic acid, malonic acid, succinic acid, glutaric acid, maleic acid, fumaric acid, adipic acid, terephthalic acid, and the like. The acid is preferably citric acid. Any base that creates a suitable buffer system may be used. An exemplary base that can be used is potassium hydroxide.

The pH adjuster can comprise up to about 90 by wt. of the final concentrate composition. For example, the pH adjuster can comprise, in the range of 0.1 to 90 wt. % of the total concentrate composition, in the range of 1 to 50 wt. % of the total concentrate composition, and in the range of 5 to 20 wt. % of the total concentrate composition.

The pH adjuster can comprise up to 25 wt. % of the use composition. For example, the pH adjuster can comprise in the range of 0 to 25 wt. % of the use composition, in the range of 0.001 to 2 wt. % of the use composition, and in the range of 0.01 to 0.2 wt. % of the use composition.

Additional Functional Ingredients

Additional functional ingredients may optionally be used to improve the effectiveness of the composition. Some non-limiting examples of such additional functional ingredients can include the following: carrier, surfactant, foamer, defoamer/antifoaming agent, hydrotrope/coupler, enzyme, chelating agent, sequestering agent, threshold inhibiting agent, antimicrobial agent or preservative, fragrance, dye, viscosity modifier, oxidizing agent, reducing agent, corrosion inhibitor, anti-etch agent, and mixtures thereof.

Carrier

The compositions may optionally include a carrier or solvent. Water is the most commonly used and preferred carrier for carrying the various ingredients in the formulation. It is possible, however, to use a water-soluble or water compatible carrier, such as alcohols and polyols. These carriers may be used alone or with water. Some examples of suitable alcohols include methanol, ethanol, propanol, butanol, and the like, as well as mixtures thereof. Some examples of polyols include glycerol, ethylene glycol, propylene glycol, diethylene glycol, and the like, as well as mixtures thereof.

When a carrier is included into the concentrate composition, it is preferably included in an amount of between about 0.01 wt. % to about 90 wt. %, between about 1.0 wt. % to about 50 wt. %, and between about 5 wt. % to about 20 wt. %.

Surfactants

The composition may optionally include additional surfactants including nonionic, anionic, amphoterics, zwitterionic, and cationic surfactants. The surfactant preferably does not render the composition ineffective or unstable.

Foam Generator and Defoamer/Antifoaming Agents

The composition may optionally include a defoaming agent or a foam inhibitor. A defoaming agent or foam inhibitor may be included for reducing the stability of any foam that is formed. Examples of foam inhibitors that may be used include silicon compounds such as silica dispersed in polydimethylsiloxane, fatty amides, hydrocarbon waxes, fatty acids, fatty esters, fatty alcohols, fatty acid soaps, ethoxylates, mineral oils, polyethylene glycol esters, polyoxyethylene-polyoxypropylene block copolymers, alkyl phosphate esters such as monostearyl phosphate and the like. A discussion of foam inhibitors may be found, for example, in U.S. Pat. No. 3,048,548 to Martin et al., U.S. Pat. No. 3,334,147 to Brunelle et al., and U.S. Pat. No. 3,442,242 to Rue et al., the disclosures of which are incorporated by reference herein. The defoamer is preferably a gemini surfactant such as an alkane diol, commercially available as Envirogem ADO1 from Air Products and Chemicals, Inc.

The composition may optionally include a foam generator. Some examples of foam generators include surfactants such as nonionic, cationic, and amphoteric compounds.

When a foam generator or a defoamer or antifoaming agent is incorporated into the concentrate composition, it is preferably included in an amount of between about 0.01 wt. % to about 50 wt. %, between about 1.0 wt. % to about 30 wt. %, and between about 10.0 wt. % and about 20 wt. %.

Hydrotrope/Coupler

The compositions may optionally include a hydrotrope, coupling agent, or solubilizer that aides in compositional stability, and aqueous formulation. Functionally speaking, the suitable couplers which can be employed are non-toxic and retain the active ingredients in aqueous composition throughout the temperature range and concentration to which a concentrate or any use composition is exposed.

Any hydrotrope coupler may be used provided it does not react with the other components of the composition or negatively affect the performance properties of the composition. Representative classes of hydrotropic coupling agents or solubilizers which can be employed include anionic surfactants such as alkyl sulfates and alkane sulfonates, linear alkyl benzene or naphthalene sulfonates, secondary alkane sulfonates, alkyl ether sulfates or sulfonates, alkyl phosphates or phosphonates, dialkyl sulfosuccinic acid esters, sugar esters (e.g., sorbitan esters), amine oxides (mono-, di-, or tri-alkyl) and $C_8$-$C_{10}$ alkyl glucosides. Preferred coupling agents for use in the present invention include n-octanesulfonate, n-octyl dimethylamine oxide, and the commonly available aromatic sulfonates such as the alkyl benzene sulfonates (e.g. xylene sulfonates) or naphthalene sulfonates, aryl or alkaryl phosphate esters or their alkoxylated analogues having 1 to about 40 ethylene, propylene or butylene oxide units or mixtures thereof. Other preferred hydrotropes include nonionic surfactants of $C_6$-$C_{24}$ alcohol alkoxylates (alkoxylate means ethoxylates, propoxylates, butoxylates, and co-or-terpolymer mixtures thereof) (preferably $C_6$-$C_{14}$ alcohol alkoxylates) having 1 to about 15 alkylene oxide groups (preferably about 4 to about 10 alkylene oxide groups); $C_6$-$C_{24}$ alkylphenol alkoxylates (preferably $C_8$-$C_{10}$ alkylphenol alkoxylates) having 1 to about 15 alkylene oxide groups (preferably about 4 to about 10 alkylene oxide groups); $C_6$-$C_{24}$ alkylpolyglycosides (preferably $C_6$-$C_{20}$ alkylpolyglycosides) having 1 to about 15 glycoside groups (preferably about 4 to about 10 glycoside groups); $C_6$-$C_{24}$ fatty acid ester ethoxylates, propoxylates or glycerides; and $C_4$-$C_{12}$ mono or dialkanolamides.

When a hydrotrope or coupler is incorporated into the concentrate composition, it is preferably included in an amount of between about 0.01 wt. % to about 25 wt. %, between about 1.0 wt. % to about 15 wt. %, and between about 5.0 wt. % and about 10 wt. %.

Enzymes

The present composition may optionally include one or more enzymes. Enzymes suitable for the inventive composition can act by degrading or altering one or more types of soil residues encountered on a surface thus removing the soil or making the soil more removable by a surfactant or other component of the cleaning composition. Both degradation and alteration of soil residues can improve detergency by reducing the physicochemical forces which bind the soil to the surface being cleaned, i.e. the soil becomes more water soluble. For example, one or more proteases can cleave complex, macromolecular protein structures present in soil residues into simpler short chain molecules which are, of themselves, more readily desorbed from surfaces, solubilized, or otherwise more easily removed by detersive compositions containing said proteases.

Suitable enzymes include a protease, an amylase, a lipase, a gluconase, a, cellulase, a peroxidase, a carrageenase, or a mixture thereof of any suitable origin, such as vegetable, animal, bacterial, fungal or yeast origin. Preferred selections are influenced by factors such as pH-activity and/or stability optima, thermostability, and stability to active detergents, builders and the like. In this respect bacterial or fungal enzymes are preferred, such as bacterial amylases and proteases, and fungal cellulases. Preferably the enzyme is a protease, a lipase, an amylase, a mannanase, a carrageenase, or a combination thereof.

A valuable reference on enzymes is "Industrial Enzymes," Scott, D., in *Kirk-Othmer Encyclopedia of Chemical Technology,* 3rd Edition, (editors Grayson, M. and EcKroth, D.) Vol. 9, pp. 173-224, John Wiley & Sons, New York, 1980.

When an enzyme is incorporated into the concentrate composition, it is preferably included in an amount of between about 0.0001 wt. % to about 10 wt. %, between about 0.001 wt. % to about 5 wt. % and between about 0.1 wt. % and about 2.0 wt. %.

Chelating/Sequestering Agent

The composition may optionally include a chelating agent, sequestering agent, or builder. These ingredients generally provide cleaning properties and chelating properties. Exemplary detergent builders that may be used include sodium sulphate, sodium chloride, starch, sugars, $C_1$-$C_{10}$ alkylene glycols such as propylene glycol, and the like. Exemplary chelating agents that may be used include phosphates, phosphonates, carboxylates, and amino-acetates. Exemplary phosphates that may be used include sodium orthophosphate, potassium orthophosphate, sodium pyrophosphate, potassium pyrophosphate, sodium tripolyphosphate (STPP), and sodium hexametaphosphate. Exemplary phosphonates that may be used include 1-hydroxyethane-1,1-diphosphonic acid, aminotrimethylene phosphonic acid, diethylenetriaminepenta(methylenephosphonic acid), 1-hydroxyethane-1,1-diphosphonic acid $CH._3C(OH)[PO(OH)_2]_2$, aminotri(methylenephosphonic acid) $N[CH_2PO(OH)_2]_3$, aminotri (methylenephosphonate), sodium salt $$\begin{array}{l} ONa.^{+} \\ | \\ POCH_2N[CH_2PO(ONa)_2]_2, \\ | \\ OH \end{array}$$

2-hydroxyethyliminobis(methylenephosphonic acid) $HOCH_2CH_2N[CH_2PO(OH)_2]_2$, diethylenetriaminepenta(-methylenephosphonic acid) $(HO)_2POCH_2N[CH_2CH_2N[CH_2PO(OH)_2]_2]_2$, diethylenetriaminepenta(methylenephosphonate), sodium salt $C_9H(_{28}-x)N_3Na_xO_{15}P_5$ (x=7), hexamethylenediamine(tetramethylenephosphonate), potassium salt $C_{10}H(_{28}-x)N_2K_xO_{12}P_4$ (x=6), bis(hexamethylene)triamine(pentamethylenephosphonic acid) $(HO_2)POCH_2N[(CH_2)_6N[CH_2PO(OH)_2]_2]_2$, and phosphorus acid $H_3PO_3$. Exemplary amino-acetates include aminocarboxylic acids such as N-hydroxyethyliminodiacetic acid, nitrilotriacetic acid (NTA), ethylenediaminetetraacetic acid (EDTA), N-hydroxyethyl-ethylenediaminetriacetic acid (HEDTA), and diethylenetriaminepentaacetic acid (DTPA). Exemplary carboxylates that may be used include tartaric acid, glucoheptonic acid, glycolic acid, 2-hydroxyacetic acid; 2-hydroxypropanoic acid; 2-methyl 2-hydroxypropanoic acid; 2-hydroxybutanoic acid; phenyl 2-hydroxyacetic acid; phenyl 2-methyl 2-hydroxyacetic acid; 3-phenyl 2-hydroxypropanoic acid; 2,3-dihydroxypropanoic acid; 2,3,4-trihydroxybutanoic acid; 2,3,4,5-tetrahydroxypentanoic acid; 2,3,4,5,6-pentahydroxyhexanoic acid; 2-hydroxydodecanoic acid; 2,3,4,5,6,7-hexahydroxyheptanoic acid; diphenyl 2-hydroxyacetic acid; 4-hydroxymandelic acid; 4-chloromandelic acid; 3-hydroxybutanoic acid; 4-hydroxybutanoic acid; 2-hydroxyhexanoic acid; 5-hydroxydodecanoic acid; 12-hydroxydodecanoic acid; 10-hydroxydecanoic acid; 16-hydroxyhexadecanoic acid; 2-hydroxy-3-methylbutanoic acid; 2-hydroxy-4-methylpentanoic acid; 3-hydroxy-4-methoxymandelic acid; 4-hydroxy-3-methoxymandelic acid; 2-hydroxy-2-methylbutanoic acid; 3-(2-hydroxyphenyl)lactic acid; 3-(4-hydroxyphenyl)lactic acid; hexahydromandelic acid; 3-hydroxy-3-methylpentanoic acid; 4-hydroxydecanoic acid; 5-hydroxydecanoic acid; aleuritic acid; 2-hydroxypropanedioic acid; 2-hydroxybutanedioic acid; erythraric acid; threaric acid; arabiraric acid; ribaric acid; xylaric acid; lyxaric acid; glucaric acid; galactaric acid; mannaric acid; gularic acid; allaric acid; altraric acid; idaric acid; talaric acid; 2-hydroxy-2-methylbutaned-ioic acid; citric acid; isocitric acid; agaricic acid; quinic acid; glucuronic acid; glucuronolactone; galacturonic acid; galacturonolactone; uronic acids; uronolactones; dihydroascorbic acid; dihydroxytartaric acid; tropic acid; ribonolactone; gluconolactone; galactonolactone; gulonolactone; mannonolactone; ribonic acid; gluconic acid; citramalic acid; pyruvic acid; hydroxypyruvic acid; hydroxypyruvic acid phosphate; methylpyruvate; ethyl pyruvate; propyl pyruvate; isopropyl pyruvate; phenyl pyruvic acid; methyl phenyl pyruvate; ethyl phenyl pyruvate; propyl phenyl pyruvate; formyl formic acid; methyl formyl formate; ethyl formyl formate; propyl formyl formate; benzoyl formic acid; methyl benzoyl formate; ethyl benzoyl formate; propyl benzoyl formate; 4-hydroxybenzoyl formic acid; 4-hydroxyphenyl pyruvic acid; 2-hydroxyphenyl pyruvic acid.

When a chelating or sequestering agent is incorporated into the concentrate composition, it is preferably included in an amount of between about 0.01 wt. % to about 50 wt. %, between about 0.5 wt. % to about 20 wt. %, and between about 5.0 wt. % to about 10 wt. %.

Threshold Inhibiting Agent

The composition may optionally include a threshold inhibiting agent to reduce or prevent the formation of crystals in the composition. Exemplary threshold inhibiting agents that may be used include phosphonocarboxylic acids, phosphonates, acid substituted polymers, and mixtures thereof. Exemplary phosphonocarboxylic acids that may be used include those available under the name Bayhibit® AM from Bayer, and include 2-phosphonobutane-1,2,4, tricarboxylic acid (PBTC). Exemplary phosphonates that may be used include amino tri(methylene phosphonic acid), 1-hydroxy ethylidene 1-1-diphosphonic acid, ethylene diamine tetra(methylene phosphonic acid), hexamethylene diamine tetra(methylene phosphonic acid), diethylene triamine penta(methylene phosphonic acid), and mixtures thereof. Exemplary phosphonates are available under the name Dequest® from Solutia. Exemplary acid substituted polymers that may be used include polyacrylates, polymethacrylates, polyacrylic acid, polyitaconic acid, polymaleic acid, and mixtures and copolymers thereof. It should be understood that the mixtures can include mixtures of different acid substituted polymers within the same general class. In addition, it should be understood that salts of acid substituted polymers can be used. An exemplary salt is sodium polyacrylate and is available under the name Acusol 929.

When a threshold inhibiting agent is incorporated into the concentrate composition, it is preferably included in an amount of between about 0.01 wt. % to about 25 wt. %, in an amount of between about 0.1 wt. % to about 10 wt. % and between about 1.0 wt. % to about 5.0 wt. %.

Antimicrobial Agent/Preservative

The compositions may optionally include an antimicrobial agent or preservative. Antimicrobial agents are chemical compositions that can be used in the composition to prevent microbial contamination and deterioration of commercial products material systems, surfaces, etc. Generally, these materials fall in specific classes including phenolics, halogen compounds, quaternary ammonium compounds, metal derivatives, amines, alkanol amines, nitro derivatives, analides, organosulfur and sulfur-nitrogen compounds and miscellaneous compounds. The given antimicrobial agent depending on chemical composition and concentration may simply limit further proliferation of numbers of the microbe or may destroy all or a substantial proportion of the microbial population. The terms "microbes" and "microorganisms" typically refer primarily to bacteria and fungus microorganisms. In use, the antimicrobial agents are formed into the final product that when diluted and dispensed using an aqueous stream forms an aqueous disinfectant or sanitizer composition that can be contacted with a variety of surfaces resulting in prevention of growth or the killing of a substantial proportion of the microbial population. Common antimicrobial agents that may be used include phenolic antimicrobials such as pentachlorophenol, orthophenylphenol; halogen containing antibacterial agents that may be used include sodium trichloroisocyanurate, sodium dichloroisocyanurate(anhydrous or dihydrate), iodine-poly(vinylpyrolidinonen) complexes, bromine compounds such as 2-bromo-2-nitropropane-1,3-diol; quaternary antimicrobial agents such as benzalconium chloride, cetylpyridiniumchloride; amines and nitro containing antimicrobial compositions such as hexahydro-1,3,5-tris(2-hydroxyethyl)-s-triazine, dithiocarbamates such as sodium dimethyldithiocarbamate, and a variety of other materials known in the art for their microbial properties. Antimicrobial agents may be encapsulated to improve stability and/or to reduce reactivity with other materials in the detergent composition.

When an antimicrobial agent or preservative is incorporated into the concentrate composition, it is preferably included in an amount of between about 0.01 wt. % to about 5 wt. %, between about 0.01 wt. % to about 2 wt. %, and between about 0.1 wt. % to about 1.0 wt. %.

Dye and Fragrance

Various dyes, fragrances including perfumes, and other aesthetic enhancing agents may also be included in the concentrate composition. Dyes may be included to alter the appearance of the composition, as for example, Direct Blue 86 (Miles), Fastusol Blue (Mobay Chemical Corp.), Acid Orange 7 (American Cyanamid), Basic Violet 10 (Sandoz), Acid Yellow 23 (GAF), Acid Yellow 17 (Sigma Chemical), Sap Green (Keyston Analine and Chemical), Metanil Yellow (Keystone Analine and Chemical), Acid Blue 9 (Hilton Davis), Sandolan Blue/Acid Blue 182 (Sandoz), Hisol Fast Red (Capitol Color and Chemical), Fluorescein (Capitol Color and Chemical), Acid Green 25 (Ciba-Geigy), and the like.

Fragrances or perfumes that may be included in the compositions include, for example, terpenoids such as citronellol, aldehydes such as amyl cinnamaldehyde, a jasmine such as ClS-jasmine or jasmal, vanillin, and the like.

When a dye or fragrance is incorporated into the concentrate composition, it is preferably included in an amount of between about 0.0001 wt. % to about 2 wt. %, between about 0.0001 wt. % to about 0.5 wt. % and between about 0.001 wt. % to about 0.01 wt. %.

Viscosity Modifier

The composition may optionally include a viscosity modifier. Some examples of viscosity modifiers that may be used include pour-point depressants and viscosity improvers such as polymethacrylates, polyisobutylenes, polyacrylamides, polyvinyl alcohols, polyacrylic acids, high molecular weight polyoxyethylenes, and polyalkyl styrenes.

When a viscosity modifier is incorporated into the concentrate composition, it is preferably included in an amount of between about 0.01 wt. % to about 15 wt. %, between about 0.1 wt. % to about 5.0 wt. %, and between about 0.5 wt. % to about 2 wt. %.

Oxidizer

The composition may optionally include an oxidizer. Any number of oxidizers may be used to oxidize soils that may be found with the metal oxide such as protein or organic soils. The oxidizer may also be used to provide physical effervescent or agitation action to the composition when reacted or degraded to form gases, thereby assisting soil removal. Some examples of oxidizers that may be used include hydrogen peroxide, alkali hypochlorites, ozone, chlorine dioxide, hypochlorous acid among other halogen containing oxidizing species.

When an oxidizer is incorporated into the concentrate composition, it is preferably included in an amount of between about 0.01 wt. % to about 30 wt. %, between about 1.0 wt. % to about 15 wt. %, and between about 3 wt. % to about 10 wt. %.

Reducing Agents

The compositions may optionally include a reducing agent. Some non-limiting examples of reducing agents that may be used include 2,6-di-tert-butyl 4-methylphenol (BE), carbamate, ascorbate, thiosulfate, monoetbanolamine (MA), diethanolamine, triethanolamine, metabisulfite salt, and an alkanol amine compound such as triethanolamine.

When a reducing agent is incorporated into the concentrate composition, it is preferably included in an amount of between about 0.01 wt. % to about 30 wt. %, between about 1.0 wt. % to about 15 wt. %, and between about 3 wt. % to about 10 wt. %.

Corrosion Inhibitor

The composition may optionally include a corrosion inhibitor. Corrosion inhibitors provide compositions that generate surfaces that are shiner and less prone to biofilm buildup than surfaces that are not treated with compositions having corrosion inhibitors. Preferred corrosion inhibitors which can be used according to the invention include phosphonates, phosphonic acids, triazoles, organic amines, sorbitan esters, carboxylic acid derivatives, sarcosinates, phosphate esters, zinc, nitrates, chromium, molybdate containing components, and borate containing components. Exemplary phosphates or phosphonic acids that may be used are available under the name Dequest (i.e., Dequest 2000, Dequest 2006, Dequest 2010, Dequest 2016, Dequest 2054, Dequest 2060, and Dequest 2066) from Solutia, Inc. of St. Louis, Mo. Exemplary triazoles that may be used are available under the name Cobratec (i.e., Cobratec 100, Cobratec TT-50-S, and Cobratec 99) from PMC Specialties Group, Inc. of Cincinnati, Ohio. Exemplary organic amines that may be used include aliphatic amines, aromatic amines, monoamines, diamines, triamines, polyamines, and their salts. Exemplary amines that may be used are available under the names Amp (i.e. Amp-95) from Angus Chemical Company of Buffalo Grove, Ill.; WGS (i.e., WGS-50) from Jacam Chemicals, LLC of Sterling, Kans.; Duomeen (i.e., Duomeen O and Duomeen C) from Akzo Nobel Chemicals, Inc. of Chicago, Ill.; DeThox amine (C Series and T Series) from DeForest Enterprises, Inc. of Boca Raton, Fla.; Deriphat series from Henkel Corp. of Ambler, Pa.; and Maxhib (AC Series) from Chemax, Inc. of Greenville, S.C. Exemplary sorbitan esters that may be used are available under the name Calgene (LA-series) from Calgene Chemical Inc. of Skokie, Ill. Exemplary carboxylic acid derivatives that may be used are available under the name Recor (i.e., Recor 12) from Ciba-Geigy Corp. of Tarrytown, N.Y. Exemplary sarcosinates that may be used are available under the names Hamposyl from Hampshire Chemical Corp. of Lexington, Mass.; and Sarkosyl from Ciba-Geigy Corp. of Tarrytown, N.Y.

The composition optionally includes a corrosion inhibitor for providing enhanced luster to the metallic portions of equipment treated with the compositions. When a corrosion inhibitor is incorporated into the concentrate composition, it is preferably included in the concentrate in an amount of between about 0.05 wt. % and about 15 wt. %, between about 0.1 wt. % and about 5 wt. % and between about 1 wt. % and about 5 wt. %.

Anti-Etch Agent

The composition may also include an anti-etch agent capable of preventing etching in glass. Examples of suitable anti-etch agents include adding metal ions to the composition such as zinc, zinc chloride, zinc gluconate, aluminum, and beryllium. The composition preferably includes in the concentrate from about 0.1 wt. % to about 25 wt. %, more preferably from about 0.1 wt. % to about 10 wt. %, and most preferably from about 1 wt. % to about 5 wt. % of an anti-etch agent.

Methods of Cleaning

The compositions may be used to remove metal oxides from surfaces and processing equipment in a variety of industries including the food and beverage industry, the dairy industry, the pharmaceutical industry, the cosmetic industry, and the semiconductor industry.

In the food and beverage industry, metal oxides are used as pigments to make food appear more pleasing. For example, food may be colored to intensify the color the consumer is expecting, to provide a uniform color throughout a product, to compensate for color loss during food processing, to make the product opaque, or to provide color to a colorless product.

In the dairy industry, metal oxides are used as pigment additives to dairy products. More specifically, titanium dioxide is often added as a whitener to low fat dairy products to create the appearance of a higher fat content. The titanium dioxide is typically added to the dairy product prior to pasteurization. During pasteurization, the dairy product is passed over a heat exchanger that heats the dairy product. This heating causes the titanium dioxide to accumulate on and around the heat exchanger creating a titanium dioxide soil. In addition to building up on and around the heat exchanger, titanium dioxide has a tendency to build up on processing equipment in areas of low dairy product flow, and areas where the dairy product incidentally contacts equipment.

In the pharmaceutical industry, metal oxides are used as pigments to color drugs as a safety feature and to give the drug a more pleasing appearance. Both the drug itself as well as the outside of the drug, for example with a tablet, may colored. In addition, printed information on a drug, such as the name of the drug on a pill, may be colored.

In the cosmetic industry, metal oxides are used as pigments in eye makeup, shading creams, and lipstick. Metal oxides are also used as pigments in soap products.

In the semiconductor industry, metal oxide particles from the polishing process build up on chips. This build up causes yield problems and performance problems.

The compositions may be used to remove metal oxides from processing equipment in several different methods. For example, the compositions may be used in conjunction with a manual cleaning step. The compositions may be applied to processing equipment as a foam. The compositions may be used in conjunction with a clean-out-of-place cleaning program where a piece of equipment is allowed to sit in a bath with the compositions. The compositions may be used in conjunction with a clean-in-place cleaning program. The compositions may also be applied to processing equipment by spraying, dipping, and immersing. The compositions may also be used in manual application as applied with a brush, mop, or similar tool. The compositions may also be used in combination with ultrasonic and megasonic energy which has shown a particular benefit in removing metal oxide particles in combination with the compositions.

It is understood that when the compositions are applied in these methods, it may be desirable to optimize the formula depending on the method. For example, when applying the compositions as a foam to processing equipment, it may be desirable to optimize the compositions to be high foaming or to be more viscous to promote cling on the processing equipment. When the using the compositions in conjunction with a CIP program, it may be desirable to optimize the formulas to be low foaming.

Clean-In-Place (CIP) Cleaning

Processing equipment, and dairy processing equipment in particular, may be cleaned using a clean-in-place (CIP) cleaning program. The actual cleaning of the in-place systems or other surfaces is accomplished with the present composition with heated, ambient or cooled water. In an embodiment the instant composition can be applied or introduced into the system at a use composition concentration. CIP typically employ flow rates on the order of about 40 to about 600 liters per minute, temperatures from ambient up to about 150° C., and contact times of at least about 10 seconds, more preferably about 30 to about 120 seconds. The present composition can remain in composition in cold (e.g., 40° F./4° C.) water and heated (e.g., 185° F./85° C.) water. Although it is not normally necessary to heat the aqueous use composition of the present composition, under some circumstances heating may be desirable to further enhance its efficacy or reduce foaming levels.

According to typical clean-in-place procedures, the concentrate composition can be effectively diluted, typically from about 0.01% to about 10%, preferably from about 0.05% to about 5%, and most preferably from about 0.2% to about 2% by weight, of all compositions of the present invention. The actual amount of the composition used will be based on the judgment of the user, and will depend on factors such as the particular product formulation of the composition, the concentration of the composition, and the degree of soiling.

A method of cleaning substantially fixed in-place process facilities can include the following steps. The process facilities are cleaned using a cleaning composition introduced into the process facilities at a temperature in the range of about 4° C. to 150° C. After introduction of the cleaning composition, the cleaning composition is held in a container or circulated throughout the system for a time sufficient to clean the process facilities. After the surfaces have been cleaned by means of the cleaning, the cleaning composition is drained. Upon completion of the cleaning step, the system optionally may be rinsed with other materials such as potable water or multiple cleaning cycles may be employed such as an acid cleaning cycle and an alkaline cleaning cycle with optionally a final sanitizing step. The composition is preferably circulated through the process facilities for 1 to 90 minutes, 5 to 60 minutes, or 10 to 30 minutes. After any desire cleaning and sanitizing steps are completed, the metal oxide removing composition may be applied to remove any metal oxide soil remaining on the process facility after the cleaning and sanitizing steps.

The present invention can be diluted with solvent, most preferably water and used in a number of cleaning fashions including single cleaning cycles as well as re-use applications.

When applying the compositions to a surface having a metal oxide soil, the composition is preferably present in an amount effective to remove at least about 10% of the metal oxide soil, at least about 15% of the metal oxide soil, at least about 20% of the metal soil, at least about 50% of the metal oxide soil, at least about 60% of the metal oxide soil, at least about 70% of the metal oxide soil, and at least about 75% of the metal oxide soil.

The nature of the interaction between the metal oxide soils and the equipment surface is not fully understood. However, it has been observed that metal oxide soils have a tendency to accumulate on equipment surfaces. Further, it has been observed that the metal oxide soils are cleaned by the compositions. While not wanting to be held to any scientific theory, it is believed that the nature of the interaction between the metal oxide soil and the surface may involve ionic forces between the charge on the surface and the charge on the metal oxide. Additionally, other forces including mechanical forces and dipole-induced dipole Van der Waals forces are believed to contribute to the buildup of metal oxides on surfaces. It is believed that metal oxides may be removed by interfering with the ionic attraction between the metal oxide and the surface. More particularly, it is believed that the metal oxide may be removed using a surfactant that interacts with the charge on the metal oxide.

Accordingly, it is understood that a cationic surfactant may be used with a pH adjuster at a pH above the isoelectric point (~point of zero charge) to remove metal oxide soils from surfaces.

For a more complete understanding of the invention, the following examples are given to illustrate some embodiment. These examples and experiments are to be understood as illustrative and not limiting. All parts are by weight, except where it is contrarily indicated.

EXAMPLES

Titanium Dioxide Soiling and Cleaning Procedure

For the examples, 1.75"×5.25"×0.05" clean 316L grade stainless steel coupons, with two holes in one end were used to simulate the surface of processing equipment. To create the titanium dioxide soil on the coupon, a 1% slurry of titanium dioxide with deionized water was prepared in an aerosolizing spray bottle. The coupons were placed on a rack in an oven heated to 150° C. Approximately 0.5 ml of the titanium dioxide slurry was sprayed on the coupon. The coupons were allowed to reach 150° C. again.

To test the removal of the titanium dioxide with the formulas, 1100 grams of soft water were preheated to 100° C. in a microwave. The heated water was added to a preweighed cleaning concentrate in a 1 L beaker to create a total of 1000 grams of cleaning composition. The beaker was placed on a stir plate and stabilized to 80° C. A 2.0" stir bar was placed into the beaker and set to 500 RPM (turbulent water). The coupons were hung in the beaker using paper clips hooked into the holes on the coupons. After 15 minutes, the coupons were removed and placed in another beaker of 1000 grams of soft water with a 2.0" stir bar set at 500 RPM (turbulent water). The coupons were removed from the soft water after 2 minutes and allowed to dry flat on a rack overnight. The coupons were then visually evaluated to determine the percent removal.

The following chart provides a brief explanation of certain chemical components used in the following examples:

TABLE 1

| Trademark/ Chemical Name | Description | Providers |
|---|---|---|
| Rhodafac PE-510 | Nonyl Phenol Ethoxylate Phosphate Ester | Rhodia |
| Citric Acid | Acid | Cargill |
| Potassium Hydroxide | Base | Vulcan Chemical |
| Rhodafac BG-510 | Alkyl Polyoxyethylene Glycol Phosphate Ester | Rhodia |
| Surfonic L24-5 | $C_{12}$-$C_{14}$ 5 Mole Alcohol Ethoxylate | Huntsman |
| Surfonic PE-2258 | Phosphate Ester | Huntsman |
| Hydrox Acetic Acid | Acid | DuPont |
| Surfonic N-40 | Nonyl Phenol 4.0 Mole (avg) Ethoxylate | Huntsman |
| Polytergent SLF-18 | $C_6$-$C_{10}$ Linear Alcohol Alkoxylate | BASF |
| Isopropyl Alcohol | Alcohol | Exxon |
| Duomeen TDO | Diamine | Akzo Nobel |
| Tomadol 45-7PA | $C_{14}$-$C_{15}$ Alcohol 7EO Aminopropane | Tomah |
| Tomadol 25-3PA | $C_{12}$-$C_{15}$ Alcohol 3EO Aminopropane | Tomah |
| DA-16/18 | $C_{12}$-$C_{14}$ Oxypropyl-1, 3-Diaminopropane | Tomah |

Example 1

Example 1 determined the removal of titanium dioxide soil when using an alkyl ethoxylate phosphate ester as the anionic surfactant at different pHs. For this example, four formulas were prepared and tested at different pHs at 185° F. according to the titanium dioxide soiling and cleaning procedure. The temperature was maintained by means of a hot plate.

TABLE 2

| | Formulas | | | |
|---|---|---|---|---|
| Component | Formula 1 wt. % in formula) | Formula 2 wt. % in formula) | Formula 3 wt. % in formula) | Formula 4 wt. % in formula) |
| Alkyl Phenol 6 Mole (avg) Ethoxylate Phosphate Ester | 0.500 | 0.500 | 0.500 | 0.500 |
| Citric Acid | 0.096 | 0.096 | 0.096 | 0.096 |
| Potassium Hydroxide | 0.025 | 0 | 0.075 | 0.130 |
| Deionized Water | 99.379 | 99.404 | 99.329 | 99.274 |
| pH of the Formula | 2.7 | 2.0 | 4.8 | 8.9 |
| % Removal After 5 minutes at 185° F. | 70% | 10% | 50% | 20% |

Formula 1 at a pH of 2.7 performed the best, or removed the most titanium dioxide soil. While not wanting to be held to any scientific theory, this is believed to be the result of the phosphate ester being at or near its solubility limit at a pH of 2.7 at that particular temperature. Formula 3 performed the second best at a pH of 4.8 followed by Formula 4 at a pH of 8.9 and formula 2 at a pH of 2.0.

Example 2

Example 2 compared the percent removal of titanium dioxide soil of a phosphate ester alone to a phosphate ester with a nonionic surfactant added using the titanium dioxide soiling and cleaning procedure.

TABLE 3

| | Formulas | |
|---|---|---|
| Component | Formula 5 (wt. % in formula) | Formula 6 (wt. % in formula) |
| Alkyl Polyoxyethylene Glycol Phosphate Ester | 0.500 | 0.500 |
| Potassium Hydroxide | 0.090 | 0.090 |
| Surfonic L24-5 | 0 | 0.075 |
| Deionized Water | 99.410 | 99.335 |
| pH of the Formula | 3.0 | 3.0 |
| % Removal After 10 minutes at 185° F. | 20% | 50% |

Formula 6 with the nonionic surfactant performed better than Formula 5, without a nonionic surfactant. While not wanting to be held to any scientific theory this is believed to be caused by lowering the relative hydrophilic-lipophilic balance of the composition thereby lowering the solubility of the surfactant mixture and inducing greater surface activity with regards to forming bilayers on the titanium dioxide surface to promote dispersion.

Example 3

Example 3 determined the impact of the phosphate ester alkyl chain on the removal of titanium dioxide soil. For this example, four formulas were prepared and tested according to the titanium dioxide soiling and cleaning procedure.

TABLE 4

| Component | Formulas: Formula 1 (wt. % in formula) | Formula 7 (wt. % in formula) | Formula 8 (wt. % in formula) | Formula 9 (wt. % in formula) |
|---|---|---|---|---|
| Nonyl Phenol 6 Mole (avg) Ethoxylate Phosphate Ester | 0.500 | 0 | 0 | 0 |
| Tridecyl 6 Mole (avg) Ethoxylate Phosphate Ester | 0 | 0.500 | 0 | 0 |
| Alkyl Phenol 7 Mole (avg) Ethoxylate Phosphate Ester | 0 | 0 | 0.500 | 0 |
| Citric Acid | 0.096 | 0.096 | 0.096 | 0 |
| Potassium Hydroxide | 0.025 | 0.025 | 0.025 | 0 |
| Deionized Water | 99.379 | 99.379 | 99.379 | 90.000 |
| Soft Water | 0 | 0 | 0 | 4.700 |
| Hydroxy Acetic Acid | 0 | 0 | 0 | 3.400 |
| Nonyl Phenol 4.0 Mole (avg) Ethoxylate | 0 | 0 | 0 | 0.100 |
| Polytergent SLF-18 | 0 | 0 | 0 | 1.000 |
| Isopropyl Alcohol | 0 | 0 | 0 | 0.500 |
| Duomeen TDO | 0 | 0 | 0 | 0.200 |
| pH of the Formula | 2.7 | 2.7 | 2.7 | Not Available |
| % Removal After 10 minutes at 185° F. | 75% | 70% | 70% | 10% |

In Example 3, Formula 1 performed the best. While not wishing to be bound to any scientific theory, this is believed to be because Formula 7 did not have a phenol, resulting in lower packing density than Formula 1. Formula 8 was more soluble than Formula 1 due to the increased degree of ethoxylation, therefore Formula 1 was closer to the solubility limit and more effective at removing metal oxide soils.

Example 4

Example 4 determined the removal of titanium dioxide soil using ether diamines having different alkyl lengths. For this example two formulas were prepared and tested according to the titanium dioxide soiling and cleaning procedure.

TABLE 5

| Component | Formulas: Formula 10 (wt. % in formula) | Formula 11 (wt. % in formula) |
|---|---|---|
| C14-C15 Alcohol 7 EO Aminopropane | 0.500 | 0 |
| C12-C15 Alcohol 3 EO Aminopropane | 0 | 0.500 |
| Deionized Water | 99.500 | 99.487 |
| pH of the Formula | 9.5 | 8.0 |
| % Removal after 5 Minutes at 175° F. | 60% | 50% |

In Example 4, Formula 10 performed the best and had a longer alkyl chain than Formula 9.

Example 5

Example 5 determined the impact of pH on the removal of titanium dioxide soils when using an ether diamine. For this example, three formulas were prepared and tested using the titanium dioxide soiling and cleaning procedure.

TABLE 6

| Component | Formulas: Formula 12 (wt. % in formula) | Formula 13 (wt. % in formula) | Formula 14 (wt. % in formula) |
|---|---|---|---|
| C12-C14 Oxypropyl-1,3-diaminopropane | 0.500 | 0.500 | 0.500 |
| Formic Acid | 0.095 | 0.095 | 0.095 |
| Potassium Hydroxide | 0.068 | 0 | 0.135 |
| Deionized Water | 99.337 | 99.405 | 99.270 |
| pH of the Formula | 7.5 | 6.3 | 12.5 |
| % Removal after 5 Minutes at 185° F. | 65% | 10% | 5% |

The optimal removal is observed at the first equivalence point of the diamine. While not wishing to be bound to any theory, it is believed that the monoprotonated form of the ether diamine provides the highest packing density of the surfactant on the titanium dioxide thus improving its removal. If the pH is too high, the amine groups will no longer be protonated and carry a charge to provide an attraction to the negatively charged surface of the titanium dioxide. If the pH is too low the titanium dioxide will not have a negative charge on its surface.

The foregoing summary, detailed description, and examples provide a sound basis for understanding the invention, and some specific example embodiments of the invention. Since the invention can comprise a variety of embodiments, the above information is not intended to be limiting. The invention resides in the claims.

What is claimed is:

1. A method for removing a metal oxide soil from a surface of processing equipment in the dairy, food and beverage, pharmaceutical, or cosmetic industries where the metal oxide soil is from a metal oxide additive, the method comprising:

a) applying a use composition to the surface containing the metal oxide soil in a clean-in-place process, the use composition comprising:

i) a pH adjuster in an amount sufficient to provide the use composition with a pH at or below 7;

ii) an anionic surfactant comprising an alkyl alkoxylate phosphate ester, wherein the anionic surfactant is present in an amount sufficient to remove at least about 10% of a metal oxide soil from the surface when the use composition is allowed to contact the surface for at least about 15 minutes at 80° C.; and iii) a carrier;

b) removing the metal oxide soil from the surface with the use composition; and c) rinsing the surface to remove the use composition and metal oxide soil.

2. The method of claim 1, wherein the anionic surfactant is nonyl phenol ethoxylate phosphate ester.

3. The method of claim 1, wherein the pH adjuster comprises citric acid.

4. The method of claim 1, wherein the pH adjuster adjusts the pH between about 1 and about 4.

5. The method of claim 1, wherein the use composition further comprises additional functional ingredients.

6. The method of claim 1, wherein the anionic surfactant is present in an amount sufficient to remove at least about 60% of the metal oxide soil from the surface.

7. The method of claim 1, wherein the anionic surfactant is present in an amount sufficient to remove at least about 70% of the metal oxide soil from the surface.

8. The method of claim 5, wherein the additional functional ingredients are selected from the group consisting of a foam generator, a defoamer, an antifoaming agent, a hydrotrope, a coupler, an enzyme, a chelating agent, a sequestering agent, a threshold inhibiting agent, an antimicrobial agent, a fragrance, a dye, a viscosity modifier, an oxidizer, a reducing agent, a corrosion inhibitor, an anti-etch agent, and mixtures thereof.

9. A method for removing a titanium dioxide soil from a surface where the titanium dioxide soil is from a titanium dioxide additive, the method comprising:

a) applying a first use composition comprising a surfactant to the surface in a clean-in-place process in an amount effective to remove a portion of a soil containing titanium dioxide, and leaving behind a titanium dioxide soil;

b) applying a second use composition to the surface containing the titanium dioxide soil in a clean-in-place process, the second use composition comprising:

i) a pH adjuster in an amount sufficient to provide the second use composition with a pH at or below 7;

ii) an anionic surfactant comprising an alkyl alkoxylate phosphate ester wherein the anionic surfactant is present in an amount sufficient to remove at least about 10% of a titanium dioxide soil from the surface when the second use composition is allowed to contact the surface for at least about 15 minutes at 80° C.; and iii) a carrier;

c) removing the titanium dioxide soil from the surface with the second use composition; and d) rinsing the surface to remove the second use composition and titanium dioxide soil.

10. The method of claim 9, wherein the first use composition is a cleaning composition.

11. The method of claim 9, wherein the first use composition is a sanitizing composition.

12. The method of claim 9, wherein the anionic surfactant is nonyl phenol ethoxylate phosphate ester.

13. The method of claim 9, wherein the pH adjuster comprises citric acid.

14. The method of claim 9, wherein the pH adjuster adjusts the pH between about 1 and about 4.

15. The method of claim 9, wherein the second use composition comprises additional functional ingredients.

16. The method of claim 9, wherein the anionic surfactant is present in an amount sufficient to remove at least about 60% of the metal oxide soil from the surface.

17. The method of claim 15, wherein the additional functional ingredients are selected from the group consisting of a foam generator, a defoamer, an antifoaming agent, a hydrotrope, a coupler, an enzyme, a chelating agent, a sequestering agent, a threshold inhibiting agent, an antimicrobial agent, a fragrance, a dye, a viscosity modifier, an oxidizer, a reducing agent, a corrosion inhibitor, an anti-etch agent, and mixtures thereof.

* * * * *